US010413007B2

(12) United States Patent
Alex

(10) Patent No.: US 10,413,007 B2
(45) Date of Patent: Sep. 17, 2019

(54) PROCESS AND PRODUCT FOR MAKING TRANSITORILY COLORED SOMBRE HAIR

(71) Applicant: Gunter Alex, Deutschland (DE)

(72) Inventor: Gunter Alex, Deutschland (DE)

( * ) Notice: Subject to any disclaimer, the term of this patent is extended or adjusted under 35 U.S.C. 154(b) by 548 days.

(21) Appl. No.: 15/149,801

(22) Filed: May 9, 2016

(65) Prior Publication Data

US 2017/0318884 A1 Nov. 9, 2017

(51) Int. Cl.
*A41G 5/00* (2006.01)
*A45D 7/00* (2006.01)

(52) U.S. Cl.
CPC ..... *A41G 5/0046* (2013.01); *A45D 7/00* (2013.01); *A45D 2007/001* (2013.01)

(58) Field of Classification Search
CPC .. A45D 2007/001; A45D 7/00; A41G 5/0046; A41G 5/004; A41G 5/00; A41G 3/0075; A41G 3/00
USPC ..... 132/201, 208, 209
See application file for complete search history.

(56) References Cited

U.S. PATENT DOCUMENTS 8,434,500 B2 5/2013 Alex
2004/0149302 A1* 8/2004 Toda ..... A41G 5/0046 132/201
2005/0268932 A1* 12/2005 Gold ..... A41G 5/0046 132/201
2011/0005544 A1* 1/2011 Lane ..... A41G 5/0073 132/201
2011/0271976 A1* 11/2011 Sasayama ..... A41G 5/0046 132/201
2012/0118315 A1* 5/2012 Goff ..... A41G 5/008 132/201

(Continued)

FOREIGN PATENT DOCUMENTS

EP 0940094 9/1999
EP 2842448 * 7/2014

(Continued)

OTHER PUBLICATIONS

Bayley, Leanne, We're all about: Sombre hair (bye bye Ombre!), Glamour online magazine, www.glamourmagazine.co.uk, Feb. 18, 2016, United Kingdom.

(Continued)

*Primary Examiner* — Tatiana L Nobrega
*Assistant Examiner* — Jennifer F Gill
(74) *Attorney, Agent, or Firm* — Robert C. Kain, Jr.

(57) ABSTRACT

A product and process for making a transitorily colored sombre hair extension that creates a natural looking sombre effect. The hair extension comprises a hair bundle consisting of a plurality of hair strands having varied lengths. The hair is colored a first color, the bundle realigned, so that the ends of the hair strands are varied in length at the top portion. Then the top half of the hair bundle is color processed to a second color. Again, the strands are realigned and the varied length hair ends are returned to the tail portion. This results in a sombre colored hair extension with a mid-section of the hair bundle that contains transitorily colored hair with a blend of the first color in the top portion of the hair bundle with the second color in the tail portion of the hair bundle.

16 Claims, 4 Drawing Sheets
(1 of 4 Drawing Sheet(s) Filed in Color)

(56) References Cited

U.S. PATENT DOCUMENTS

| | | | | |
|---|---|---|---|---|
| 2014/0338690 | A1* | 11/2014 | Morgaman | A45D 8/36<br>132/201 |
| 2016/0015107 | A1* | 1/2016 | Sehovic | A41G 5/0073<br>132/201 |

FOREIGN PATENT DOCUMENTS

| | | |
|---|---|---|
| JP | 2002275719 | 9/2002 |
| WO | WO 89/05104 | 6/1989 |

OTHER PUBLICATIONS

"What is the balayage effect?", Vogue Australia online magainzine, www.vogue.com.au, Aug. 23, 2011, Australia.
PCT Search Report for PCT/EP/2017/055142, filed Mar. 6, 2017, dated May 11, 2017.

* cited by examiner

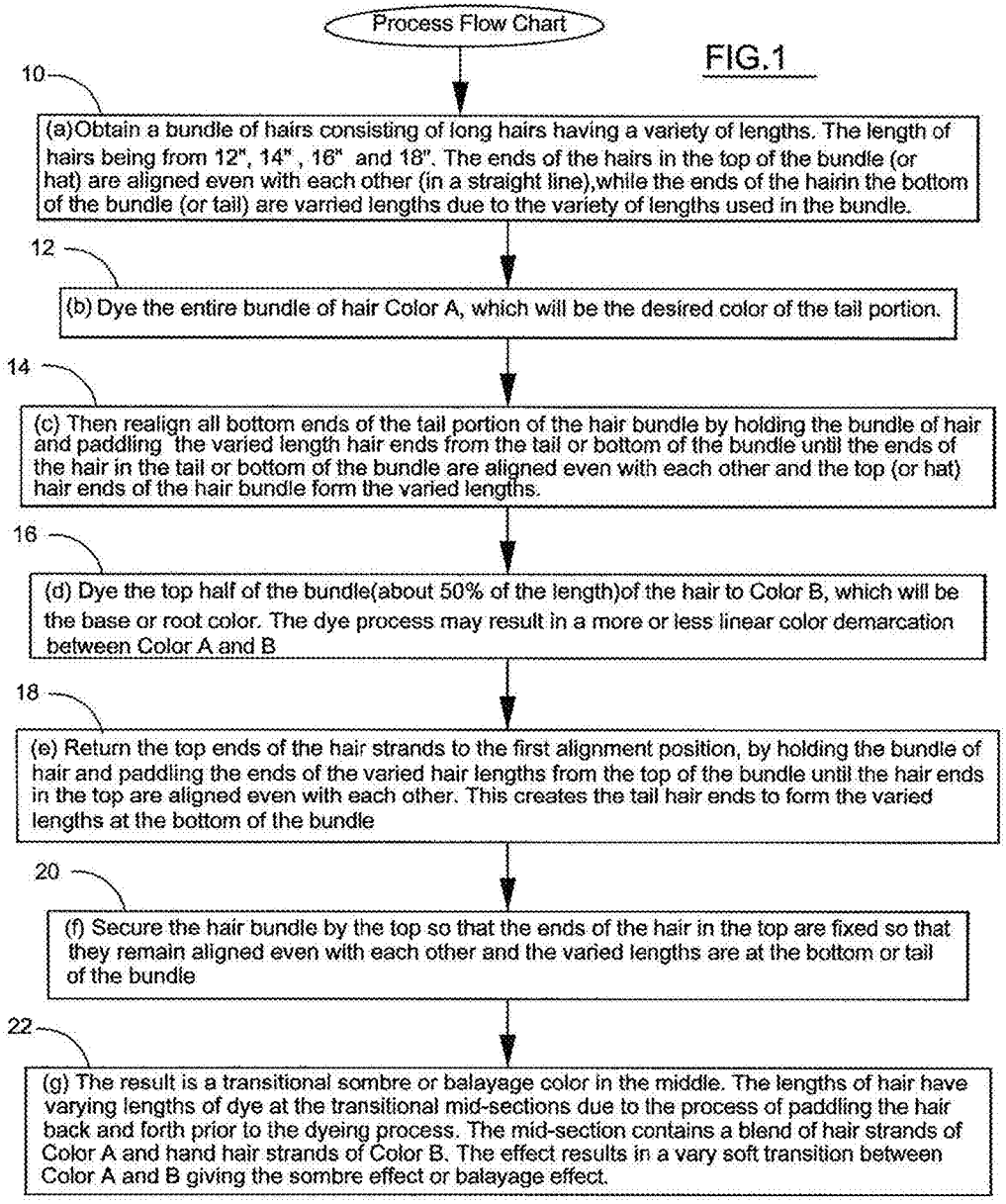
Process Flow Chart
FIG.1
10
(a)Obtain a bundle of hairs consisting of long hairs having a variety of lengths. The length of hairs being from 12", 14", 16" and 18". The ends of the hairs in the top of the bundle (or hat) are aligned even with each other (in a straight line),while the ends of the hairin the bottom of the bundle (or tail) are varried lengths due to the variety of lengths used in the bundle.
12
(b) Dye the entire bundle of hair Color A, which will be the desired color of the tail portion.
14
(c) Then realign all bottom ends of the tail portion of the hair bundle by holding the bundle of hair and paddling the varied length hair ends from the tail or bottom of the bundle until the ends of the hair in the tail or bottom of the bundle are aligned even with each other and the top (or hat) hair ends of the hair bundle form the varied lengths.
16
(d) Dye the top half of the bundle(about 50% of the length)of the hair to Color B, which will be the base or root color. The dye process may result in a more or less linear color demarcation between Color A and B
18
(e) Return the top ends of the hair strands to the first alignment position, by holding the bundle of hair and paddling the ends of the varied hair lengths from the top of the bundle until the hair ends in the top are aligned even with each other. This creates the tail hair ends to form the varied lengths at the bottom of the bundle
20
(f) Secure the hair bundle by the top so that the ends of the hair in the top are fixed so that they remain aligned even with each other and the varied lengths are at the bottom or tail of the bundle
22
(g) The result is a transitional sombre or balayage color in the middle. The lengths of hair have varying lengths of dye at the transitional mid-sections due to the process of paddling the hair back and forth prior to the dyeing process. The mid-section contains a blend of hair strands of Color A and hand hair strands of Color B. The effect results in a vary soft transition between Color A and B giving the sombre effect or balayage effect.

A'
A"
32
30
34

A'
A"
30
(Color A)

to FIG.2e
32
34
B'
B"

32
38
(Color B)
37
40
(Color A remains)

PROCESS AND PRODUCT FOR MAKING TRANSITORILY COLORED SOMBRE HAIR

This is a regular, nonprovisional patent application.

The present invention relates to a process and product for making transitorily colored sombre hair. The transitorily colored hair extension creates a natural looking sombre effect.

BACKGROUND OF THE INVENTION

It is increasingly fashionable to have hair with a different color on the terminal end portion or hair segments furthest from the scalp. The most current trend is to have a very soft or subtle blending of colors from the scalp section to the terminal end section, which is sometimes called a sombre effect. Sombre offers a more natural, blended look as opposed to ombre, which provided a more harsh distinction between the colors. The hair is typically darker on top and lighter near the ends. Often, the ends are a shade of blond and the top is a darker shade of blond or brown, which is the root color. The middle segment is a blend of the darker and lighter shades or colors and creates a transitory section.

For a more dramatic look, the end portion of the hair can be vibrantly colored with colors such as blue, lavender, pink, green, orange, etc. This look is often achieved by dyeing or color processing the end portions of a person's hair with vibrant colored dye. However, color processing the hair is a semi-permanent or permanent process, when in fact the person may only want the colored hair to last for a certain duration.

Another color blending technique is balayage. The balayage technique is a freehand technique where color is applied by hand rather than using the traditional foiling or cap highlighting technique. Balayage can achieve varying effects, including soft, natural highlights similar to the sombre effect. Both the sombre effect and balayage are performed at a salon, both are very time consuming and both are very expensive to have done at a salon due to the artful blending of the two colors to create a natural look.

The color blending look of the sombre effect is difficult to achieve in hair extensions. It has been attempted to achieve the sombre look in extensions by use of two lengths of hairs in the extension, each of a different color. The combination of the two groups of hair creates an ombre or sombre effect in the final hair extension. However, the problem with the technique of creating an ombre or sombre effect with two lengths of hairs in differing colors is that the ends of the shorter hairs absorb more dye or color. This results in a distorted ombre or sombre effect and does not appear as natural as desired, nor does the color appear as it would in a natural sombre effect or one created by a salon. Additionally, use of two lengths of hair can create a noticeable volume discrepancy at the bottom of the hair extension.

Moreover, the color created in an ombre or sombre extension can be negatively altered by the strands of hairs having different appearances caused by the hair strands taking up various amounts of color due to the hair strands cuticles being in different directions. Natural hair has overlapping scales (called cuticles) that lay in the same direction when growing from a head. When hair is cut and used in an extension, it is ideal to keep the hair running in the same direction. For example, it is desired that the hair strands in the extension all be in the same direction as they were on the original head of hair, namely from scalp to terminal end.

There are no known hair extensions that create the sombre effect in a manner that is comparable to the quality of sombre color received at a salon. The sombre color produced at a salon contains a transitory section where the colors are artfully blended to arrive a soft transition between the colors. Most currently available sombre hair extensions have a harsh demarcation between the two colors. An extension with salon quality sombre coloring is desired. Sombre extensions can be used to add volume to already existing sombre colored hair. Or sombre extensions can be used to add a sombre color and length to existing hair.

Hair extensions, hairpieces, and wigs are known. Hair extensions are lengths of hair attachable to a user's head to make the user's hair appear either fuller, longer or add color. Wigs and hair pieces likewise can be used to change the appearance (color, length, and/or texture) of the user's hair. The current invention provides a process and product for making transitorily colored hair which overcomes the forgoing disadvantages of the above mentioned hair color processing issues.

OBJECTS OF THE INVENTION

It is an object of the present invention to provide a process and product for making transitorily colored sombre hair for extensions.

It is also an object of the present invention to provide transitorily colored sombre hair for an extension or hair piece that is easy to use for a period and does not require the user to permanently or semi-permanently dye or color process their natural hair. An extension or wig provides the desired look without the user having to perform the work of color processing their hair, undertake the expense of having it done and subject their own hair through possible damage. It is also desired to provide a sombre extension that can also allow a user to add length to their existing hair and create a sombre effect or add length and volume to existing sombre colored hair.

It is an object of the present invention to provide a process and product for making transitorily colored sombre hair that has a very natural and soft transitional mid-section that provides a transition from one color to another. It is an object of the invention to create a product and process for making a transitorily colored sombre hair extension that creates a natural looking sombre effect.

SUMMARY OF THE INVENTION

The present invention provides a process for creating transitorily colored sombre hair for a hair extension comprising obtaining a hair bundle consisting of a plurality of hair strands having varied lengths not longer than 24 inches in length, the hair bundle having a top portion and a tail portion. In the first processing step, the top ends of the hair strands are aligned with each other in the hair bundle and the bottom ends of the tail portions form the varied lengths of the hair bundle. In a second processing step, the entire hair bundle is color processed to a first color. In a third processing step, all bottom ends of the tail portion of the hair bundle are realigned such that the top ends form the varied lengths of the hair bundle. In a fourth processing step, the top of the realigned hair bundle is color processed to a second color. In a fifth processing step, the top ends of the hair strands are returned to the first alignment position such that top ends of the hair strands are aligned with each and the bottom ends form the varied lengths of the hair bundle. The result is a mid-section which is transitorily colored, that is, the hair bundle has a transitorily colored mid-section.

The present invention also provides a process for creating transitorily sombre colored hair. The hair bundle is color processed to a first color. The hair bundle consists of a plurality of hair strands having varied lengths, the hair bundle having a top portion and a tail portion, the top ends of the hair strands being aligned with each to form a top-aligned hair bundle. The hair bundle is realigned so that the bottom ends of the hair strands form a bottom-aligned hair bundle. The top portion of the realigned hair bundle is color processed to a second color. Further re-aligning the hair bundle and forming the top-aligned hair bundle such that the hair bundle has varied tail portion lengths. The process results in a mid-section that is transitorily sombre colored, with blended first color and second color hair strands.

The present invention further provides a transitorily colored hair extension comprising a hair bundle consisting of a plurality of hair strands having varied lengths. The hair extension includes a top portion and a tail portion, wherein the ends of the hair strands are aligned even with each other at the top portion of the hair bundle and the ends of the hair strands are varied in length at the tail portion of the hair bundle. The plurality of hair strands have cuticles that all lie in the same direction. The top portion of the hair bundle is a first color and the tail portion is a second color. A mid-section of the hair bundle contains transitorily colored hair that contains a blend of hair strands of the first color with hair strands of the second color. The transitory or mid-section of the hair bundle is created by color processing the entire hair bundle to the first color, altering the alignment of the ends of the plurality of hair strands so that the ends of the hair strands are aligned even with each other at the tail portion and the ends of the hair strands are varied in length at the top portion. Next, the top of the hair bundle is color processed to a second color. The alignment of the ends of the hair strands are then altered so that the ends of the hair strands are aligned even with each other at the top portion and the ends of the hair strands are varied in length at the tail portion.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The subject matter which is regarded as the invention is particularly pointed out and distinctly claimed in the claims at the conclusion of the specification. The foregoing and other objects, features, and advantages of the invention will be apparent from the following detailed description when taken in conjunction with the accompanying drawings.

FIG. 1 is a process flow diagram showing the process for making transitorily colored hair.

DETAILED DESCRIPTION OF THE PREFERRED EMBODIMENTS

Figures 2A, 2B, 2C, 2D:
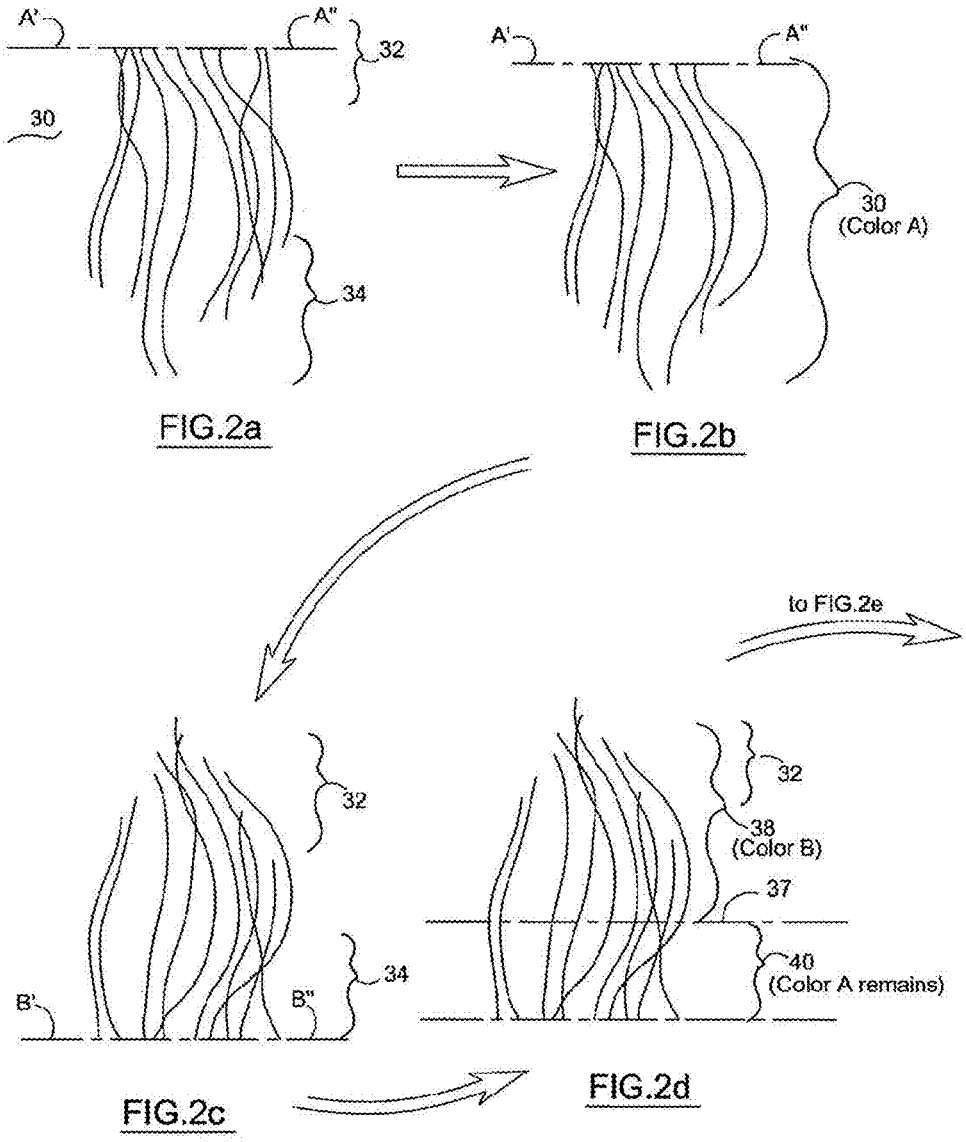
FIGS. 2*a*, 2*b*, 2*c*, 2*d* and 2*e* are process schematics showing the starting hair bundle, the physical manipulation of the hair bundle and the color processing steps.

Referring now to the drawings, the invention will be described in more detail. It is important to note that the embodiments of the invention described below are only examples of the several advantageous uses of the innovative teachings described herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality.

The transitory colored hair has the appearance of having two colors (a top portion and a bottom portion) that transition and blend into each other softly. Often the two colors are just lighter or darker shades of the same color. Herein, the transitory colored hair will generally be referred to for use in hair extensions, however, it is under stood that the color process and method of manufacture can be used on extensions, hair clip pieces, hair bands, wigs and any other known device that contains hair strands.

The process is depicted in the flow chart in FIG. 1. In the first step 10, a bundle of hair is obtained consisting of long hairs having a variety of lengths. The length of the hairs may range from 12" to 18". Such a bundle would include a plurality of hair strands of the lengths of 12", 14", 16", 17", and 18". The bundles of hairs may be any length, but will include a variety of hair lengths therein. Generally, the top of the bundle, or the portion which is nearest the scalp, may be referred to herein as the top or hat interchangeably. The bottom of the bundle, or the portion which contains the terminal ends of the hair, is referred to herein as the bottom or tail and the terms may be used interchangeably. The top portion and bottom portion of the hair bundle create a fixed orientation of the hair bundle which maintains the plurality of cuticles laying in the same direction on the hair strands. When the cuticles of all the hair strands are in the same direction, the result is a better extension or hair piece, which appears more like natural hair and has hair strands that accept color uniformly. The top ends of the hair strands are aligned with each other in the hair bundle and the bottom ends of the tail portions form the varied lengths of the hair bundle. This is the normal configuration of the final hair extension.

In the next step 12, the entire bundle of hair is dyed or processed to color A. Color A will be desired color of the tail portion or the terminal end of the hairs of the finished product. All the hair strands of the bundle are dyed one color. Any known color process or dye may be used. The next step 14, all bottom ends of the tail portion of the hair bundle are realigned such that the top ends form the varied lengths of the hair bundle. This occurs by the varied hair lengths being pushed up from the bottom or tail, by holding the bundle of hair and paddling the varied length hair ends from the tail or bottom of the bundle until the ends of the hair in the tail or bottom of the bundle are aligned even with each other or in a straight line and the top hair ends of the hair bundle form the varied lengths. The terms "pushed" and "paddled" are used to show the mechanical realignment of the hair ends between being even with each other at the tail portion and at the top portion of the hair extension. Any known method of mechanically realigning the hair ends may be used, including by-hand methods and automated mechanical systems.

In step 16, the top half of the hair bundle, about 50% of the length of the bundle, is dyed a second color B. Color B is considered the root or base color. This dyeing process may result in a more or less linear color demarcation between color A and color B. In step 18, the top ends of the hair strands are returned to the first alignment position such that top ends of the hair strands are aligned with each other and the bottom ends form the varied lengths of the hair bundle. This occurs by the top hairs, which are now varied in length, being pushed down in the bundle, by holding the bundle of hair and paddling the ends of the varied hair lengths from the top or hat of the bundle until the hair ends in the top are aligned in a straight line or become even with each other. This creates the tail hair ends to form the varied lengths at the bottom of the bundle, and the top hair ends are now even with each other.

In step 20, the hair bundle is secured by the top so that the ends of the hair in the top are fixed such that they remain aligned even with each other and the varied lengths are again at the bottom or tail of the bundle. In step 22, the result is a transitional color in the middle section or mid-segment of the hair bundle that gives the overall appearance of the sombre effect or balayage effect in the hair extension. Each hair has differing portions of the lengths dyed at the transitional mid-section due to the process of paddling the hair back and forth prior to and after the dyeing step. The effect results in a very soft transition between color A and B giving the sombre effect or balayage effect. The realignment during the coloring process also keeps the cuticles of the hair strands all in the same direction and produces a high quality hair extension or hair piece.

The process schematics in FIGS. 2*a*, 2*b*, 2*c*, 2*d* and 2*e* show the starting hair bundle 30, the physical manipulations of the hair bundle 30 and the color processing steps. In FIG. 2*a*, the hair bundle 30 has a top portion 32 and a tail or bottom portion 34. The ends of the hairs in the top portion 32 of the bundle 30 are aligned even with each other in a straight line A'-A". The length of the hairs strands may range from 12" to 24" or longer. If the hair bundle 30 length is 18" at its longest, such a hair bundle 30 would include hairs of the lengths of 12", 14", 16", 17", and 18". Other embodiments can include longer or shorter hairs and ranges.

FIG. 2*b* shows the entire bundle of hair 30 is dyed or processed to color A. Color A will be the desired color of the terminal ends of the hair. In one embodiment, color A will be a lighter color, such as a blond color.

FIG. 2*a* shows the varied lengths in the tail portion 34 of hair bundle 30. FIG. 2*c* shows the hair bundle 30 after the ends in the tail portion 34 have been realigned to be even with each other and form a straight line B'-B" in the tail portion 34. All the bottom ends of the tail portion 34 are realigned at B'-B" shown in FIG. 2*c*. The top portion 32 of the hair bundle now forms the varied lengths. To achieve this realignment, the hair is pushed or paddled from the varied length ends at the bottom of tail portion 34 until the hair ends are aligned even with each other at the bottom end of tail portion 34. This forms or creates the varied lengths at the top portion 32 of the hair bundle 30.

After the hair ends are aligned in the tail portion 34 at B'-B" in FIG. 2*c*, the top half 38 (a top sectional portion in FIG. 2*d*) of the hair extension is dyed to color B, as shown in FIG. 2*d*. In one embodiment, color B is a darker color than color A, such that if color A is blonde, color B is a dark blonde or brown color. Color B is considered the root or base color. As shown in FIG. 2*d*, color A remains on the bottom half 40 (a bottom sectional portion in FIG. 2*d*) of the hair bundle 30. Due to this variety in lengths and the realignment of the hair ends, a differing amount of length of each hair is dyed when the top half of the hair extension is dyed. This results in variation of color A and B in the transitorily colored mid-section and creates the soft blending of colors. However, before the hair is realigned in FIG. 2*e*, the hair extension of FIG. 2*d* will have a distinct line of demarcation 37 between color A and B.

Figure 2E:
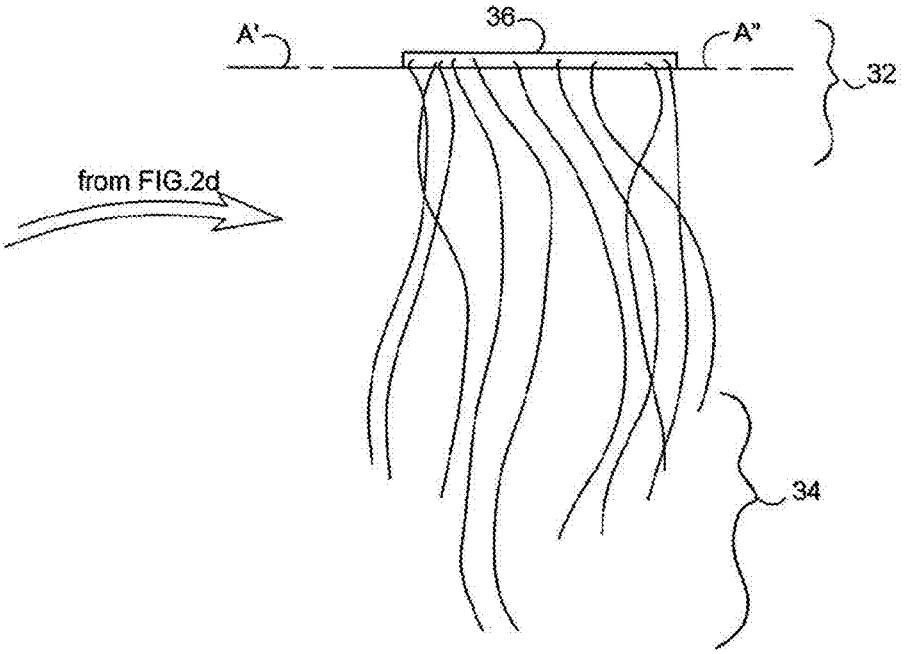
Figure 3:
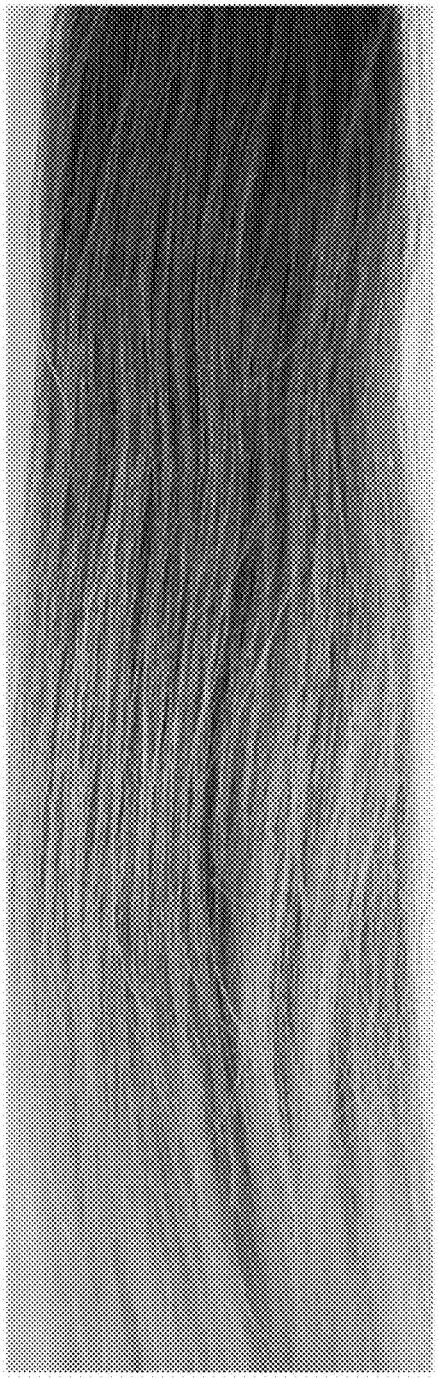
FIG. 3 is a color photograph showing transitorily colored hair.

The varied lengths of hair ends in the top portion 32 of the hair bundle in FIG. 2*d* are pushed or paddled down to align even with each other and form a straight line in the top portion 32 hair bundle as shown in FIG. 2*e*. FIG. 2*e* shows the hair bundle 30 with the top portion 32 realigned even with each other to form a straight line. The varied lengths are returned to the tail portion 34 of the hair bundle. The top portion 32 of the hair bundle, in which the hair ends are aligned even with each other, can be secured into one extension or hair piece with tape, polyurethane or any known securing method 36. Optionally, the hair bundle 32 can be split into several smaller volume extensions or hair pieces and then secured together.

In an alternate embodiment, the entire hair bundle can be dyed Color B (similar to the step shown in FIG. 2*b*). Then, the varied lengths in the tail portion are realigned to be even with each other and form a straight line in the tail portion. The top of the hair bundle now contains the varied lengths (similar to step shown in FIG. 2*c*). Then, instead of dyeing the top portion of the hair bundle, the bottom portion 48 of the hair bundle is dyed to Color A. After, the top ends of the hair strands are returned to the first alignment position such that top ends of the hair strands are aligned with each other and the bottom ends form the varied lengths of the hair bundle. This results in a transitorily colored hair bundle mid-section.

While the preferred embodiment of the invention has been described using specific terms, such description is for illustrative purposes only, and it is to be understood that changes and variations may be made without departing from the spirit or scope of the following claims. The claims appended hereto are meant to cover modifications and changes within the scope and spirit of the present invention.

What is claimed is:

1. A process for creating transitorily colored hair for a hair extension comprising the steps of:

obtaining a hair bundle consisting of a plurality of hair strands having varied lengths not longer than 24 inches in length with the lengths extending in a vertical direction, the hair bundle having a top portion and a bottom portion wherein the top portion comprises the top end of each strand of the plurality of strands and the opposite bottom portion comprises the bottom end of each strand of the plurality of strands;

in a first processing step, the top ends of the top portion of the plurality of hair strands are initially aligned with each other in the hair bundle along a first horizontal line that is perpendicular to the vertical direction and the bottom ends of the bottom portion form a first varied length, in a second processing step, color processing the entire hair bundle to a first color;

in a third processing step, realigning the bottom ends of the bottom portion of the hair bundle along a second horizontal line that is perpendicular to the vertical direction such that the top ends of the top portion form a second varied length;

in a fourth processing step, color processing a top of the realigned hair bundle to a second color;

in a fifth processing step, returning the top ends of the top portion of the plurality of hair strands to the initial alignment position in the first processing step such that the top ends of the top portion of the plurality of hair strands are aligned with each other along the first horizontal line and the bottom ends of the bottom portion reform the first varied length; and resulting in a transitorily colored hair bundle mid-section.

2. The process of claim 1, wherein the first color is a lighter or darker color than the second color.

3. The process of claim 2, wherein the second color is a darker shade of the first color.

4. The process of claim 1, wherein the top ends or the bottom ends of the plurality of hair strands are aligned by paddling the top ends or the bottom ends of the plurality of hair strands until the top ends or the bottom ends are even with each other.

5. The process of claim 1, wherein the top ends or the bottom ends of the plurality of hair strands are aligned by pushing the top ends or the bottom ends of the plurality of hair strands until the top ends or the bottom ends are even with each other.

6. The process of claim 1, wherein the top portion and bottom portion of the hair bundle maintain a plurality of cuticles laying a same direction on the plurality of hair strands.

7. The process of claim 1, after the fifth processing step, further comprising a step of securing the top portion of the hair bundle together to form a hair extension.

8. A process for creating transitorily sombre colored hair comprising the steps of:

color processing a hair bundle to a first color, the hair bundle consisting of a plurality of hair strands having varied lengths with the lengths extending in a, the hair bundle having a top portion and a bottom portion wherein the top portion comprises the top end of each strand of the plurality of strands and the opposite bottom portion comprises the bottom end of each strand of the plurality of strands, the top ends of the top portion of the plurality of hair strands being aligned with each other along a first horizontal line that is perpendicular to the vertical direction to form a top-aligned hair bundle;

realigning the plurality of hair strands of the top-aligned hair bundle so that the bottom ends of the bottom portion of the plurality of hair strands are aligned along a second horizontal line that is perpendicular to the vertical direction so as to form a bottom-aligned hair bundle;

color processing a top portion of the bottom-aligned hair bundle to a second color; and further re-aligning the top ends of the top portion of the plurality of hair strands of the hair bundle along the first horizontal line and reforming the top-aligned hair bundle such that the bottom ends of the hair bundle have a varied bottom portion length;

thereby creating a mid-section that is transitorily sombre colored, with the plurality of strands forming blended first color and second color hair strands.

9. The process of claim 8, wherein the top ends or the bottom ends of the plurality of hair strands are realigned by paddling the top ends or the bottom ends of the plurality of hair strands to form the bottom-aligned hair bundle.

10. The process of claim 8, wherein the top ends or the bottom ends of the plurality of hair strands are realigned by pushing the top ends or the bottom ends of the plurality of hair strands to form the bottom-aligned hair bundle.

11. The process of claim 8, wherein the first color is a lighter shade of the second color.

12. The process of claim 8, wherein the hair bundle consists of the plurality of hair strands having varied lengths ranging from 12 inches to 24 inches.

13. The process of claim 8, wherein the top portion and the bottom portion of the hair bundle maintain a plurality of cuticles laying in a same direction on the plurality of hair strands.

14. A process for creating transitorily sombre colored hair comprising the steps of:

color processing a hair bundle to a first color, the hair bundle consisting of a plurality of hair strands having varied lengths with the lengths extending in a vertical direction, the hair bundle having a top portion and a bottom portion vertical direction wherein the top portion comprises the top end of each strand of the plurality of strands and the opposite bottom portion comprises the bottom end of each strand of the plurality of strands, the top ends of the top portion of the plurality of hair strands being aligned with each other along a first horizontal line that is perpendicular to the vertical direction to form a top-aligned hair bundle;

realigning the top-aligned hair bundle so that the bottom ends of the bottom portion of the plurality of hair strands are aligned along a second horizontal line that is perpendicular to the vertical direction so as to form a bottom-aligned hair bundle;

color processing the bottom portion of the realigned hair bundle to a second color; and further re-aligning the bottom-aligned hair bundle by re-aligning the top ends of the plurality of hair strands along the first horizontal line and reforming the top-aligned hair bundle such that the hair bundle has a varied bottom portion length;

thereby creating a mid-section that is transitorily sombre colored, with the plurality of strands forming blended first color and second color hair strands.

15. A process for creating transitorily colored hair for a hair extension comprising the steps of:

obtaining a hair bundle consisting of a plurality of hair strands having a first color and a first varied length, the length of the strands extending in a vertical direction, the hair bundle having a top portion and a bottom portion, and each strand of the plurality of hair strands having a top end in the top portion and a bottom end in the bottom portion;

aligning all the bottom ends of the bottom portion of the plurality of hair strands with each other along a first horizontal line that is perpendicular to the vertical direction such that the top ends of the bottom portion display a second varied length;

color processing the top portion of the aligned hair bundle to a second color;

realigning the top ends of the top portion of the plurality of hair strands with each other along a second horizontal line that is perpendicular to the vertical direction and the bottom ends of the bottom portion forming the first varied length; and resulting in a transitorily colored hair bundle mid-section.

16. The process of claim 15, wherein after realigning, the bottom portion of the realigned hair bundle is said second color and the top portion of the realigned plurality of hair strands remains the first color.

* * * * *